US009120659B2

(12) United States Patent
Bailey

(10) Patent No.: US 9,120,659 B2
(45) Date of Patent: Sep. 1, 2015

(54) MULTIPLE-WAY BOTTLE CAP OPENER AND METHOD

(71) Applicant: Brewster Manufacturing, Inc., Brewster, WA (US)

(72) Inventor: Chris Bailey, Brewster, WA (US)

(73) Assignee: Brewster Manufacturing, Inc., Brewster, WA (US)

( * ) Notice: Subject to any disclaimer, the term of this patent is extended or adjusted under 35 U.S.C. 154(b) by 190 days.

(21) Appl. No.: 13/779,185

(22) Filed: Feb. 27, 2013

(65) Prior Publication Data

US 2014/0238199 A1 Aug. 28, 2014

(51) Int. Cl.
*B67B 7/18* (2006.01)
*B67B 7/16* (2006.01)

(52) U.S. Cl.
CPC .... *B67B 7/18* (2013.01); *B67B 7/16* (2013.01)

(58) Field of Classification Search
CPC ..... B67B 7/16; B67B 7/18
USPC ..... 81/3.09, 3.4, 3.41, 3.55
See application file for complete search history.

(56) References Cited

U.S. PATENT DOCUMENTS

| | | | | | |
|---|---|---|---|---|---|
| D42,070 | S | | 12/1911 | Vaughan | |
| 1,899,203 | A | | 2/1933 | Labreche | |
| 2,041,391 | A | | 5/1936 | Bauch | |
| 2,856,804 | A | * | 10/1958 | Whiteley | 81/3.55 |
| D228,224 | S | | 8/1973 | Schlanger | |
| D266,479 | S | | 10/1982 | Hayakawa | |
| 4,433,597 | A | * | 2/1984 | Rowland | 81/3.09 |
| 4,474,087 | A | * | 10/1984 | Widman | 81/3.09 |
| D277,725 | S | | 2/1985 | Silkebakken et al. | |
| D278,024 | S | | 3/1985 | Hoffman et al. | |
| D278,203 | S | * | 4/1985 | Braukmann | D8/40 |
| D278,950 | S | | 5/1985 | Vaughan | |
| D287,093 | S | | 12/1986 | Ryan | |
| 4,633,740 | A | | 1/1987 | Jacobs | |
| D288,224 | S | | 2/1987 | Rockwell | |
| 4,829,618 | A | | 5/1989 | McKee | |
| 4,846,024 | A | | 7/1989 | Bryant et al. | |
| D303,345 | S | | 9/1989 | Sawatsky et al. | |
| D307,225 | S | | 4/1990 | Freidenfelds | |
| D311,668 | S | | 10/1990 | Bryant et al. | |
| 4,967,622 | A | | 11/1990 | Phillips | |
| 5,090,277 | A | | 2/1992 | Spiller | |
| D325,499 | S | | 4/1992 | Wilder | |
| D335,432 | S | | 5/1993 | Vaughan | |
| D399,108 | S | * | 10/1998 | Koefelda | D8/38 |
| D440,134 | S | | 4/2001 | Brix-Hansen | |
| D603,237 | S | | 11/2009 | Corredor-Londono | |
| D630,070 | S | | 1/2011 | Mazur | |

* cited by examiner

*Primary Examiner* — David B Thomas
(74) *Attorney, Agent, or Firm* — Wells St. John P.S.

(57) ABSTRACT

A beverage opener is provided having a body and a receiver. The body has a generally planar bottom surface, an outer peripheral edge, and a top surface. The receiver has a wall portion defining a recess in the bottom surface of the body. The receiver also has an array of spaced-apart ones of: a) recesses and b) notches disposed about the recess to provide a bottle opener. The array of ones of: a) recesses and b) notches are compatibly formed to receive and mate with a first array of another of: a) recesses and b) notches on one twist-off bottle cap and a second, distinct array of another of: a) recesses and b) notches on another twist-off bottle cap. A pry-off crown cap opener can also be provided along the receiver. A promotional branding beverage opener is also provided.

20 Claims, 17 Drawing Sheets

MULTIPLE-WAY BOTTLE CAP OPENER AND METHOD

TECHNICAL FIELD

This disclosure pertains to beverage container openers. More particularly, this disclosure relates to crown cap bottle openers capable of opening a plurality of uniquely different crown caps from a bottle.

BACKGROUND OF THE INVENTION

Practically every homeowner has one or more beverage container openers for opening crown caps from a bottle. One specific opener removes pry-off crown caps. Another specific opener removes twist-off crown caps. Some specific openers incorporate both types of openers on a single frame or body, in spaced apart relation. However, a user often needs to have multiple unique beverage container openers at their disposal when faced with opening multiple unique crown cap configurations. Furthermore, a user often faces unnecessary effort when determining which of a plurality of unique bottle openers on a common beverage opener is needed in order to open a specific type of crown cap from a bottle. Even furthermore, users often desire compactness, smooth handedness, and storable availability of beverage openers, especially when enjoying beverages during recreational activities where portability and pocket-ability are desirable. Finally, providers of beverage openers often desire the provision of a surface portion on a beverage opener suitable for providing advertising in a manner that increases daily consumer exposure and awareness of advertised branding.

SUMMARY OF THE INVENTION

Disclosed herein is an apparatus for removing crown caps from bottles having a plurality of unique crown cap configurations from a list of twist-off crown caps, pry-off crown caps, and multiple-unique-flute-arrangement crown caps each having a unique number of flutes extending about an outer periphery.

According to one aspect, a beverage opener is provided having a body and a receiver. The body has a generally planar bottom surface, an outer peripheral edge, and a top surface. The receiver has a wall portion defining a recess in the bottom surface of the body. The receiver also has an array of spaced-apart ones of: a) recesses and b) notches disposed about the recess to provide a bottle opener. The array of ones of: a) recesses and b) notches are compatibly formed to receive and mate with a first array of another of: a) recesses and b) notches on one twist-off bottle cap and a second, distinct array of another of: a) recesses and b) notches on another twist-off bottle cap.

According to another aspect, a beverage opener is provided a body and a receiver. The body has a base with a generally planar bottom surface, an outer peripheral edge, and a top surface. The receiver has a wall portion defining a recess in the bottom surface of the body. The receiver includes: a) a first bottle opener communicating with the recess along one peripheral edge portion; and b) a second bottle opener communicating with the recess along another peripheral edge portion spaced from the first bottle opener.

According to yet another aspect, a promotional branding beverage opener, comprising: a body having a bottom surface and a dome-shaped top surface with a promotional branding surface portion configured to receive at least one of: (a) an image and (b) a design component; and an annular peripheral sidewall portion defining a cavity in the bottom surface of the body and having a first bottle opener comprising an array of spaced-apart ones of: a) recesses and b) notches disposed about the cavity to provide a bottle opener, the array of ones of: a) recesses and b) notches compatibly formed to receive and mate with a first array of another of: a) recesses and b) notches on one twist-off bottle cap and a second, distinct array of another of: a) recesses and b) notches on another twist-off bottle cap.

BRIEF DESCRIPTION OF THE DRAWINGS

Preferred embodiments of the disclosure are described below with reference to the following accompanying drawings.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

Using a beverage opener having one or more bottle openers capable of removing more than a single configuration of crown cap, a user need only possess a single opener in order to enable opening of multiple unique crown cap configurations. For example, some crown caps are pry-off crown caps, while other crown caps are twist-off crown caps. Provision is made for a single beverage opener with one or more bottle openers provided contiguously within a common socket, or recess and capable of removing at least two distinctly different configurations of crown caps from bottles. As another example, some crown caps have a first number of radially extending and circumferentially spaced-apart flutes (e.g., 21 flutes), while other crown caps have a second number of radially extending and circumferentially spaced-apart flutes (e.g., 27 flutes), and it is desirable to use a single beverage opener when removing these two unique types of caps.

Figure 1:
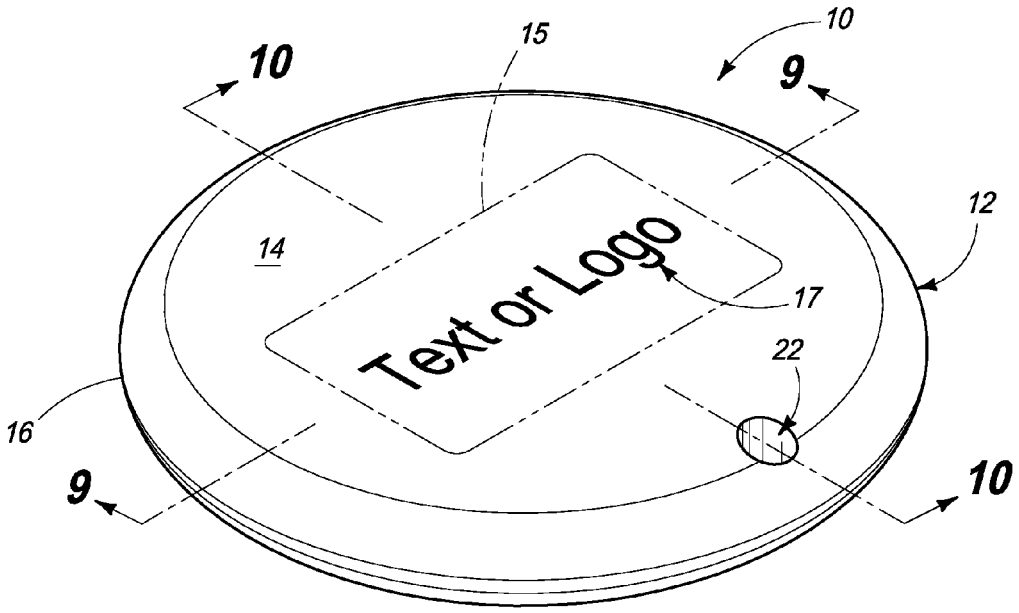
FIG. 1 is perspective view from above of a beverage opener according to one aspect.

In FIG. 1, a representation of an illustrative integral beverage opener is shown and identified by reference numeral 10. Beverage opener 10 has an ergonomic, hand-conforming shape comprising a cylindrical disk-shaped, or domed, oblate spheroid shaped body 12 with a top surface 14 comprising a portion of a semispherical surface, a cylindrical, arcuate, and completely smooth outer diameter peripheral wall portion 16, and a flat, cylindrical bottom surface 18 (see FIG. 2). Surfaces 14 and 18 are contiguous with wall portion 16 according to such illustrative construction. Optionally, body 12 can be any of a number of hand-conforming shapes including semispherical, disc, or flat shapes with a conforming peripheral edge, or wall portion. Even further optionally, body 12 can be shaped with a top surface that is shaped like an object, such as a football, a geographic region, or a mascot, or any other shape of a recognizable object.

As shown in FIG. 1, a promotional branding surface portion 15 is provided atop top surface 14. An image and/or design component (such as "Text or Logo") 17 is provided within surface portion 15, either as a pleasing display to the user, or as a way of presenting advertising, such as corporate advertising, to the user. To facilitate viewing, a pair of rare earth magnets 28 and 30 (see FIG. 2) are adhesively bonded into complementary apertures 24 and 26 in bottom surface 18 such that bottom surface 18 of beverage opener 10 can be magnetically adhered to metal surfaces, such as the front door of a refrigerator. In one case, cyanoacrylate is used to bond magnets 28 and 30 within apertures 24 and 26, respectively. In another case, epoxy is used to bond magnets 28 and 30 within apertures 24 and 26. Optionally, magnets 28 and 30 can each be any form or type of magnet, and magnets 28 and 30 can be press-fit within apertures 24 and 26, respectively.

Also shown in FIGS. 1-5 and 7-8, a cylindrical through-bore 22 is provided through body 12, extending between top surface 14 and bottom surface 18. Bore 22 is configured to receive a lanyard, cord, or other form of clip suitable for affixing body 12 as a pendant to a ring of keys, thereby providing a keychain lanyard and pendant.

Figure 2:
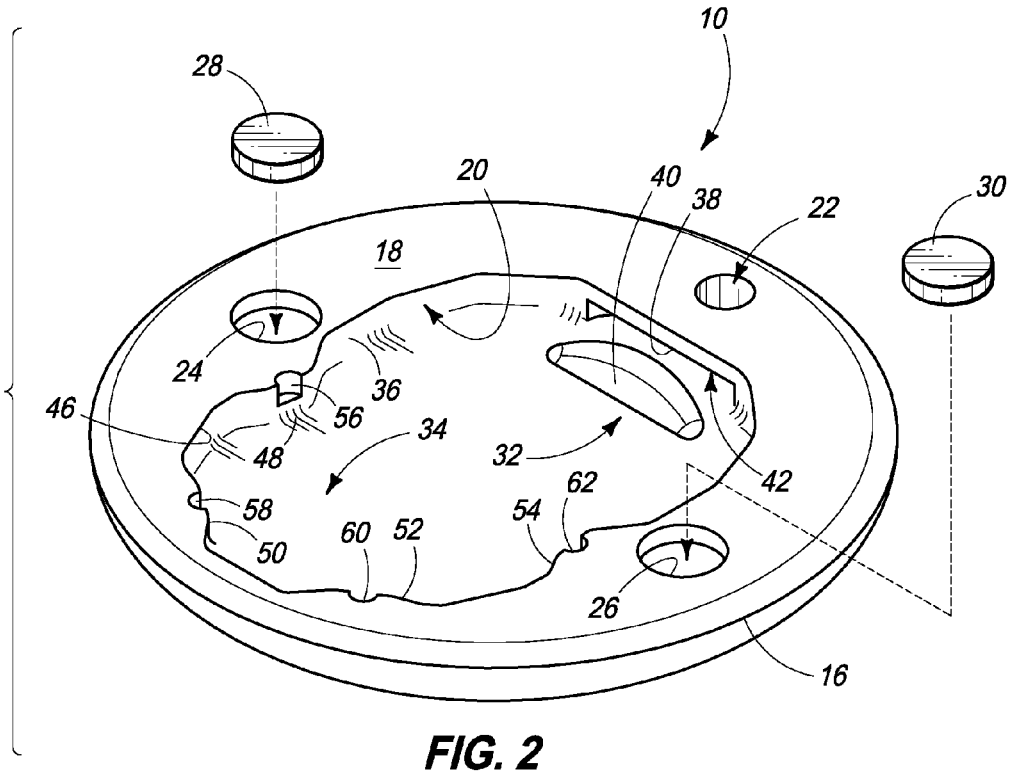
FIG. 2 is a partially exploded perspective view from below of the beverage opener of FIG. 1.

As shown in FIG. 2, beverage opener 10 has a receiver, or recess 20 in bottom surface 18 that provides an elongate cavity. A wall portion 36 is formed within the generally planar bottom surface 18 of body 12 that extends in a closed circuit to define recess 20. Two unique types of bottle openers 32 and 34 are provided along respective, spaced apart peripheral portions of recess 20. Recess 20 provides an elongate cavity 20 extending between the first peripheral portion 32 and the second peripheral portion 34. Elongate cavity 20 is configured at least in part to provide a guide way, or raceway via opposed surfaces of wall portion 36 that is operative to enable tactile navigation of a bottle cap that is urged (by hand) into cavity 20 between the first bottle opener 32 and the second bottle opener 34. It is not necessary that a bottle cap be narrower than a width of cavity 20, as long as one edge of the bottle cap can be received into cavity 20 and be guided by hand via wall portion 36 between openers 32 and 34. Furthermore, openers 32 and 34 are positioned outwardly from a center position of cylindrical body 12 in order to maximize leverage imparted by a user's hand when twisting off or prying off a crown cap from a bottle with beverage opener 10.

As shown in FIG. 2, bottle opener 32 is a pry-off crown cap bottle opener. Bottle opener 34 is a twist-off crown cap bottle opener provided spaced apart at an opposed end of recess 20 relative to bottle opener 32.

Bottle opener 32 includes an arcuate clearance recess 40 formed in bottom surface 35 of recess 20, as shown in FIG. 2. A cap pry lip, or ledge 38 is formed by an undercut cavity 42 formed in body 12, adjacent and contiguous with recess 20. Recess 40 comprises a straight edge that progresses into a deepening cavity such that the straight edge provides a crimping, or breaking line (and a fulcrum point) that bends a bottle cap when prying such cap from a bottle.

Bottle opener 34 includes an array of spaced-apart recesses 56, 58, 60 and 62 disposed about recess 20 so as to provide a twist-off crown cap bottle opener 56, as shown in FIG. 2. The array of recesses 56, 58, 60 and 62 are compatibly formed to receive and mate with a first array of notches on one twist-off bottle cap and a second, distinct array of another notches on another twist-off bottle cap. Optionally, recesses 56, 58, 60 and 62 can each be notches that are configured to mate with recesses provided between adjacent flutes on a crown bottle cap. Each recess 56, 58, 60 and 62 is provided in a local radially-inwardly extending projection, or lug 48, 50, 52 and 54, respectively. A radially outwardly extending relief, or cavity is provided between each adjacent lug 56, 58, 60 and 62, for example, relief 46 is provided between adjacent lugs 56 and 58.

Figure 3:
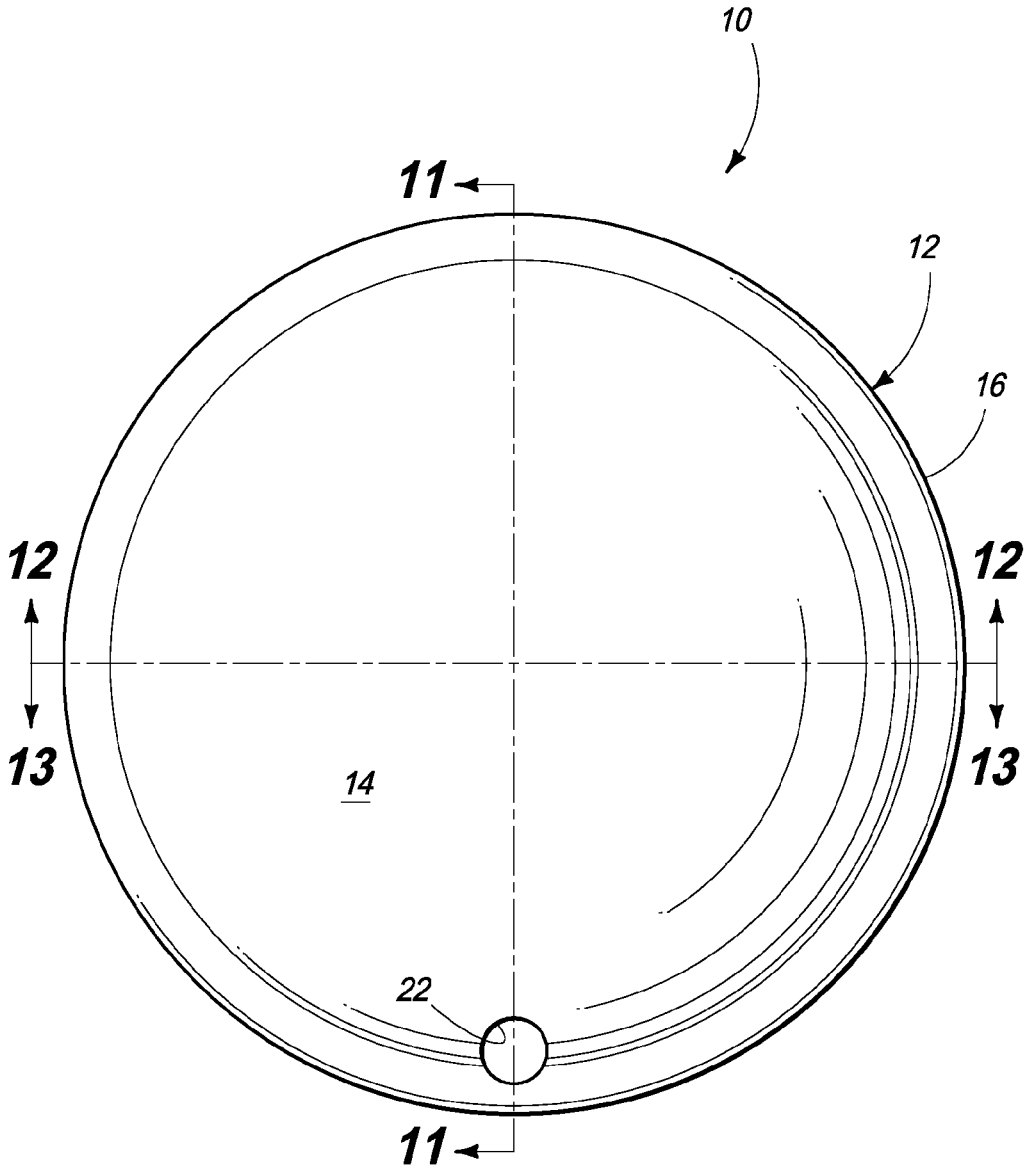
FIG. 3 is a plan view from above of the beverage opener of FIGS. 1 and 2.
Figure 4:
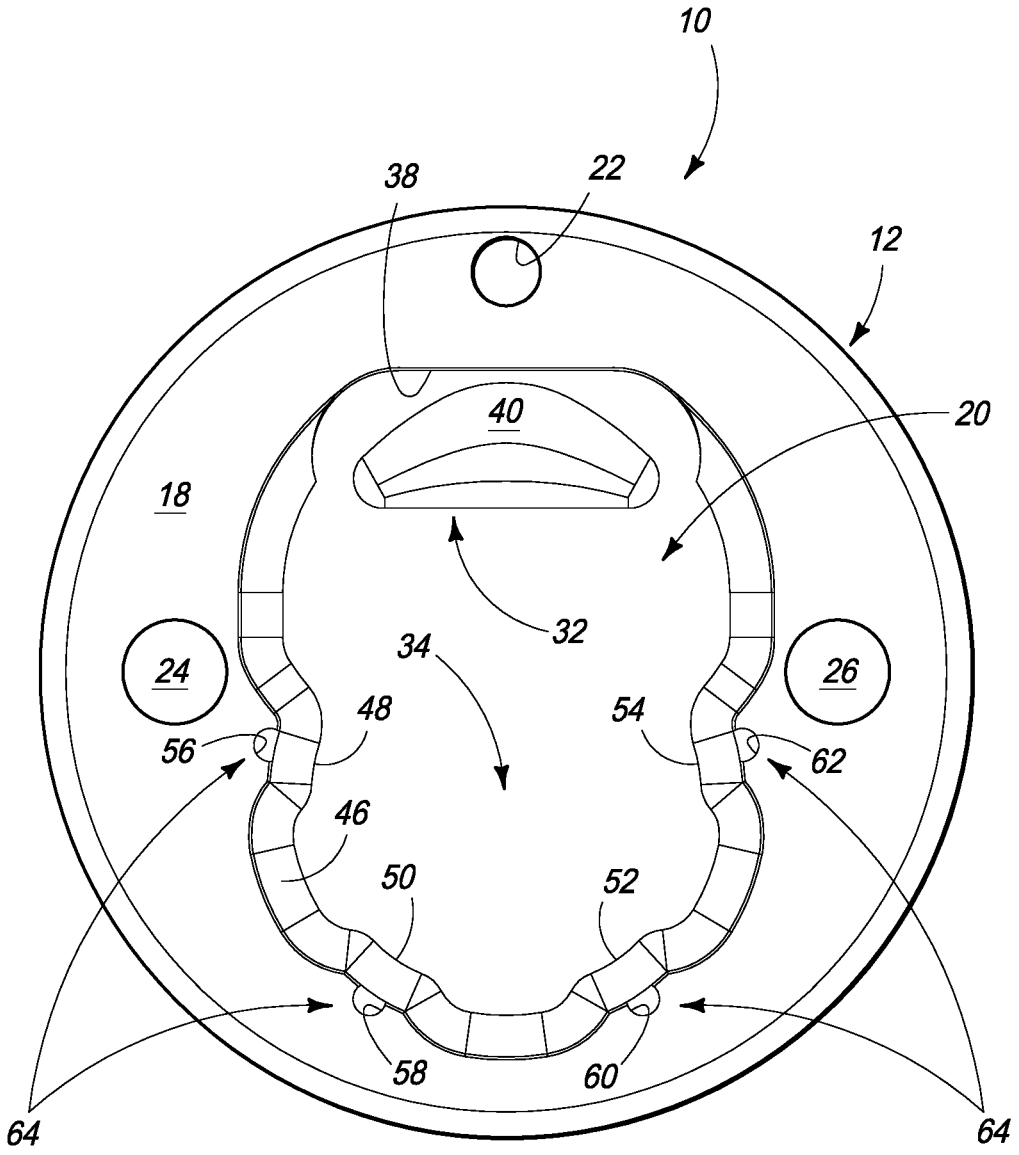
FIG. 4 is a plan view from below of the beverage opener of FIGS. 1-3.

A shown in FIGS. 3 and 4, body 12 of beverage opener 10 has a cylindrical outer peripheral wall portion 16. Optionally, body 12 can have any of a number of outer peripheral geometries including square, elliptical, rectangular, or any other suitable shape that is capable of being grasped within a palm of a user's hand.

Figure 7:
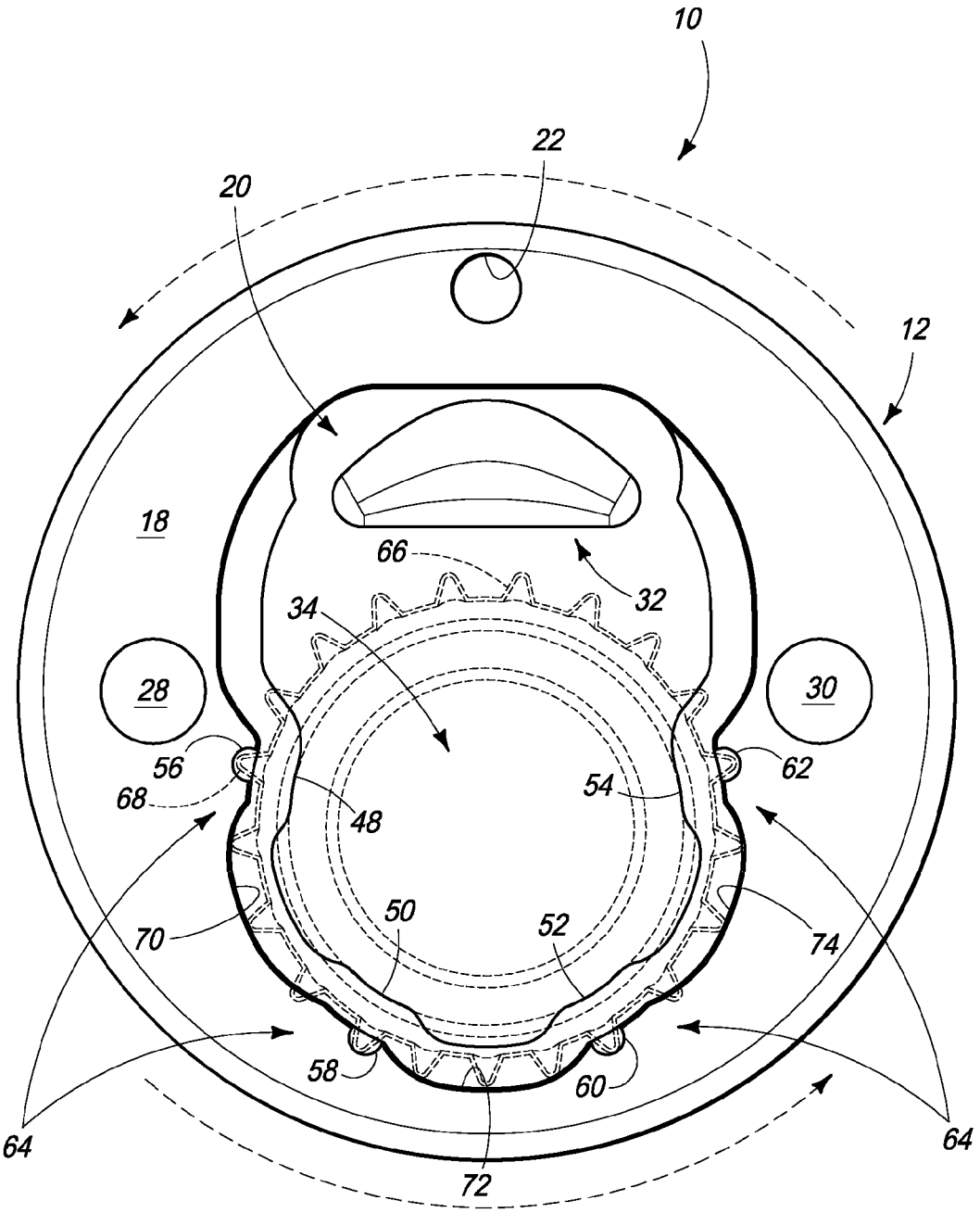
FIG. 7 is a plan view from below illustrating a twist-off crown cap (but with bottle removed to facilitate viewing) inserted into a twist-off crown cap opener of the beverage opener.

FIG. 4 illustrates the manner in which array 62 of notches 56, 58, 60 and 62 are spaced apart and configured to receive a twist-off crown bottle cap 66 (see FIG. 7).

Figure 5:
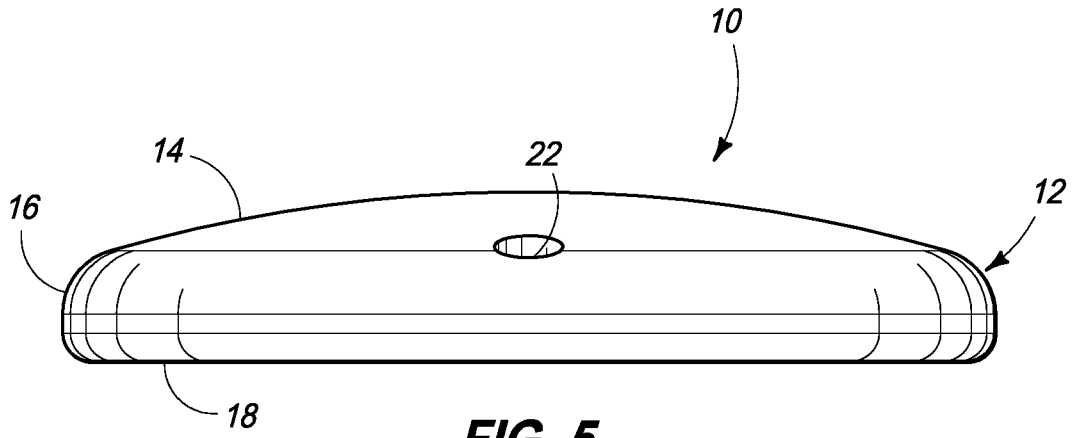
FIG. 5 is a front elevational view of the beverage opener of FIG. 4.
Figure 6:
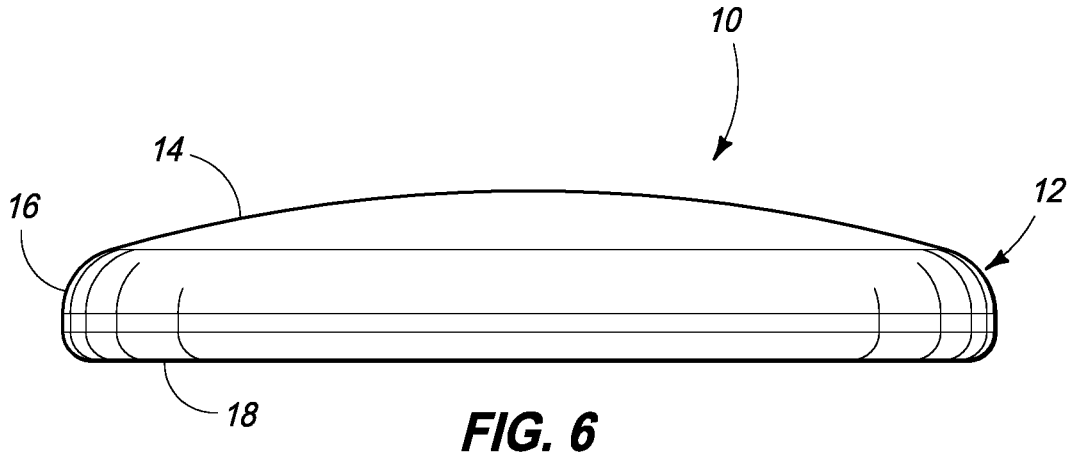
FIG. 6 is a rear elevational view of the beverage opener of FIG. 4.

Body 12 of beverage opener 10 has a hemispherical top surface 14, as shown in FIGS. 5 and 6. Outer peripheral wall portion 16 has a cylindrical, arcuate, and completely smooth outer diameter configured to accommodate hand-conforming fit-up in a user's palm to facilitate gripping and prying of opener 10 when engaging a crown bottle cap on a bottle. Top surface 14 and outer peripheral edge 18 cooperate to provide at least a portion of a semispherical head having ergonomically compatible fit-up with a user's hand when rotating body 12 while a bottle cap is received within recess 20 and bottle opener 34 of opener 10. Optionally, top surface 14 can have a flat, hemispherical, or any other suitable geometric shape capable of accommodating mating with the palm of a user's hand when removing a crown bottle cap from a bottle.

Bottle opener 34 is configured to provide a first bottle opener provided along one peripheral portion of recess 20, and bottle opener 32 is configured to provide a second bottle opener along an opposite peripheral portion of recess 20, as shown in FIG. 7. More particularly, bottle opener 34 provides a receiver having an array of spaced-apart recesses 56, 58, 60, and 62, each configured to mate with a complementary notch 68 on a twist-off bottle cap 66. Bottle openers 32 and 34 each communicate with a respective peripheral edge portion of recess 20. Furthermore, recess 20 provides an elongate cavity extending between a first peripheral edge portion and a second peripheral edge portion of recess 20. Such elongate cavity forms a guideway, or raceway operative to enable tactile navigation of a bottle cap that is urged into cavity 20 between the first bottle opener 32 and the second bottle opener 34. In one case, a single top end of a bottle cap can be received within cavity 20 to provide a raceway for guiding positioning of the cap within the opener 10. In another case, the cavity 20 is wider than the top-most surface of the cap, and the entire top surface of the case is received within the cavity 20 where it is guided between opener 32 and 34 within cavity 20.

Figure 8:
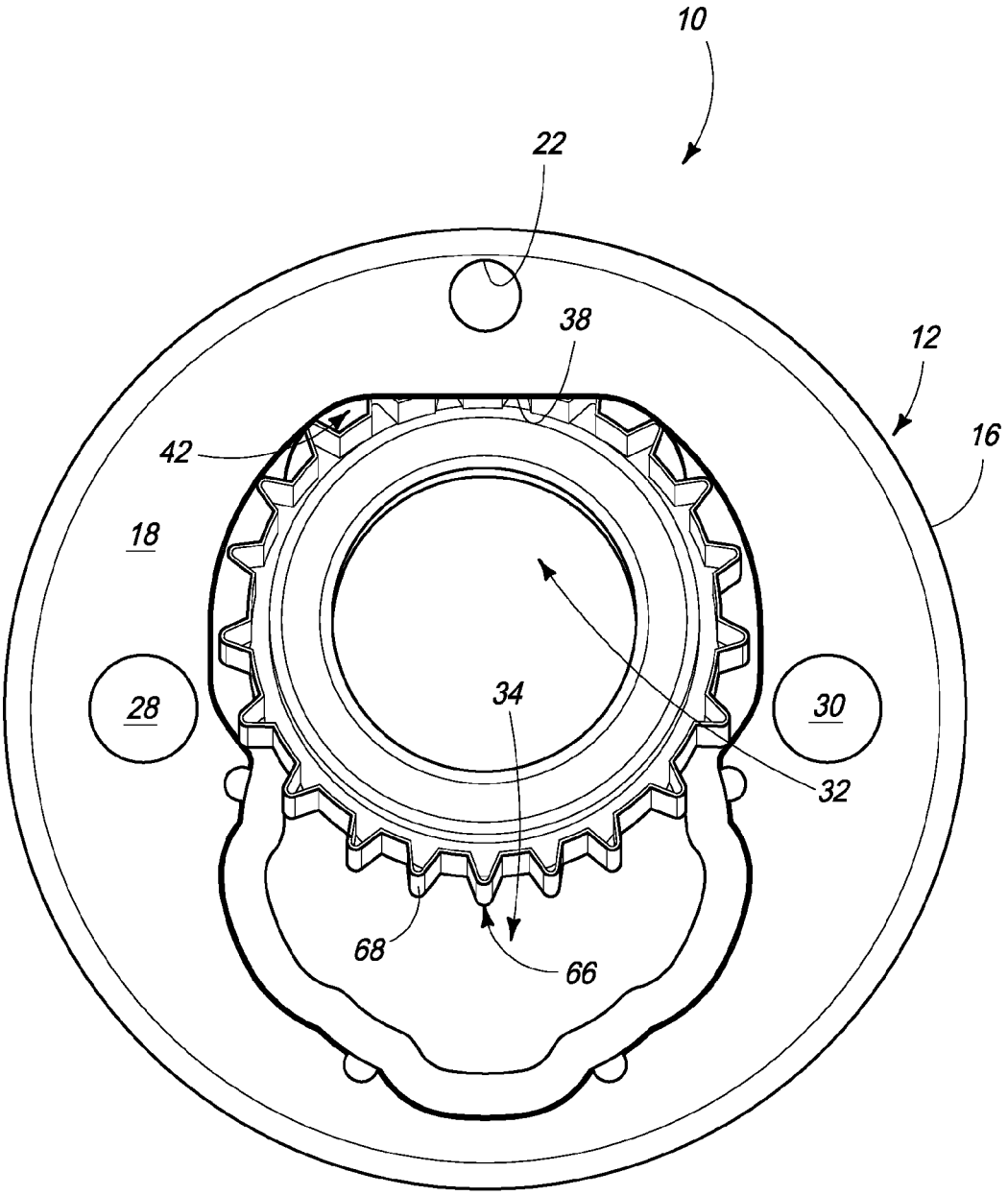
FIG. 8 is a plan view from below illustrating a pry-off crown cap (but with bottle removed to facilitate viewing) inserted into a pry-off crown cap opener of the beverage opener.

FIG. 8 depicts a pry-off crown bottle cap 66 received within bottle opener 32 of beverage opener 10. More particularly, one edge of cap 66 has flutes 68 received within undercut cavity 42 of body 12 and beneath lip 38. Lip 38 exerts pressure on such captured flutes as bottle opener 10 is hand manipulated in order to apply bending pressure to opener 10 that bends the captured flutes 68, so as to open cap 66 from a bottle (removed to facilitate viewing), as further depicted in FIG. 14.

Figure 9:
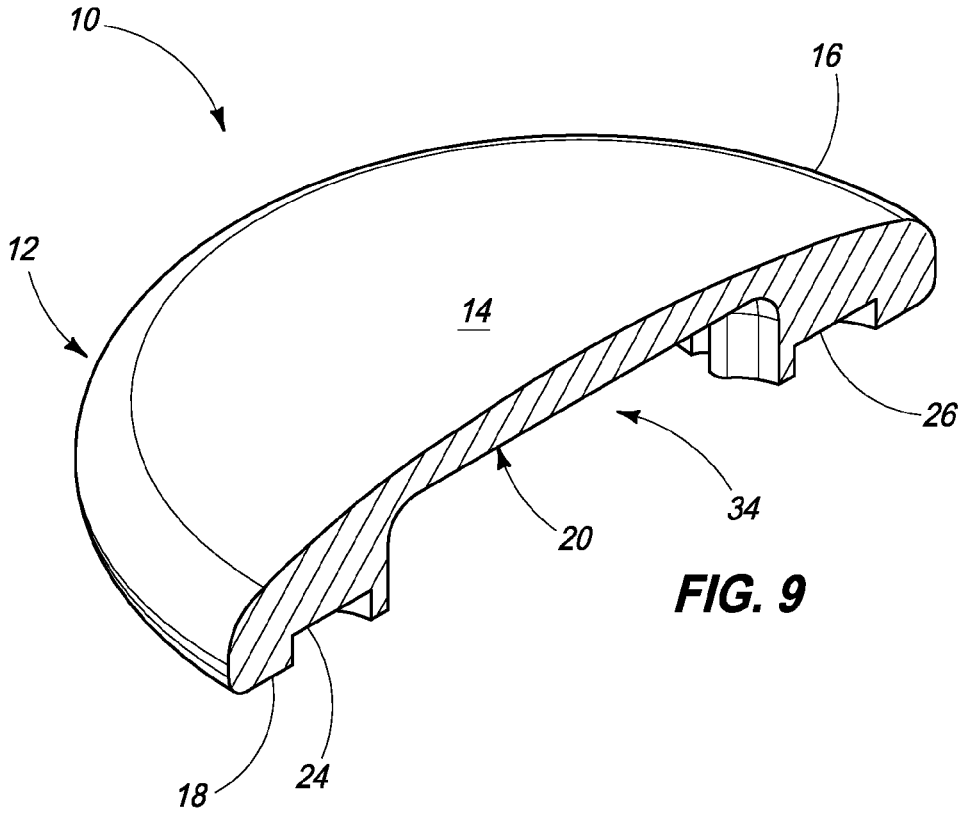
FIG. 9 is perspective centerline sectional view of the beverage opener from above taken along line 9-9 of FIG. 1.
Figure 10:
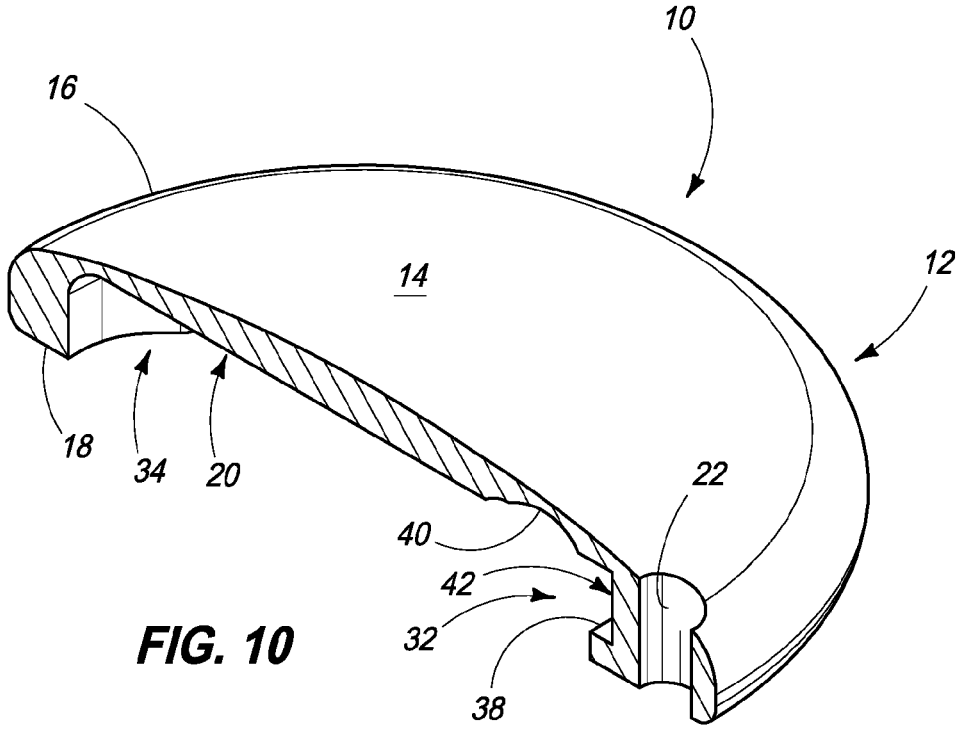
FIG. 10 is a perspective centerline sectional view of the beverage opener from above taken along line 10-10 of FIG. 1.
Figure 11:
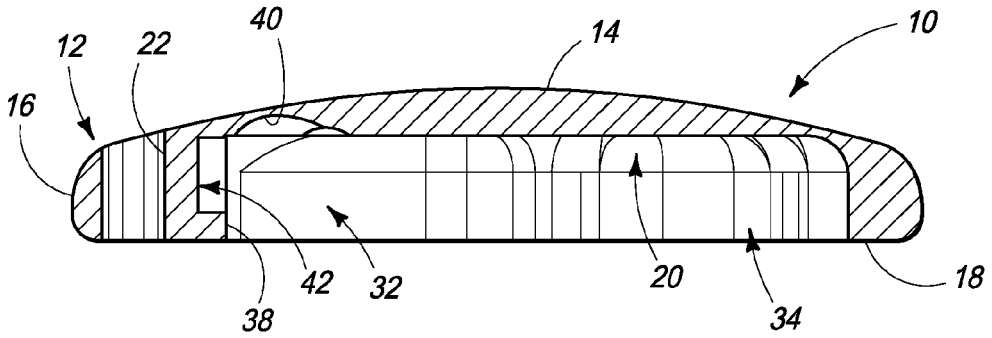
FIG. 11 is a vertical centerline sectional view of the beverage opener taken along line 11-11 of FIG. 3.
Figure 12:
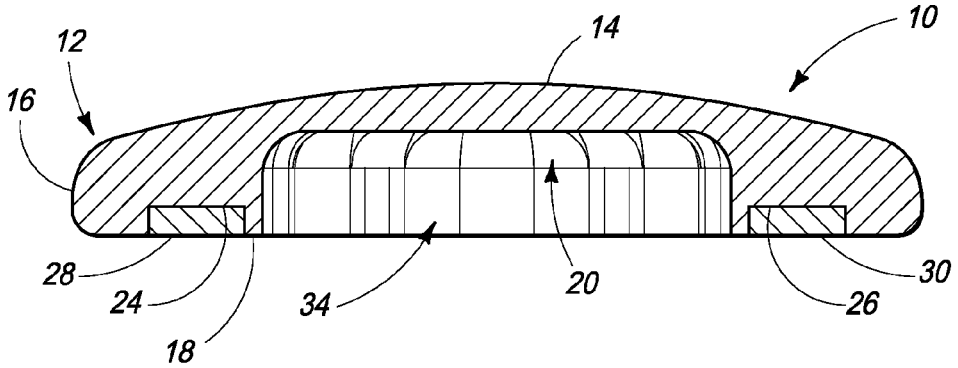
FIG. 12 is a vertical centerline sectional view of the beverage opener taken along line 12-12 of FIG. 3.
Figure 13:
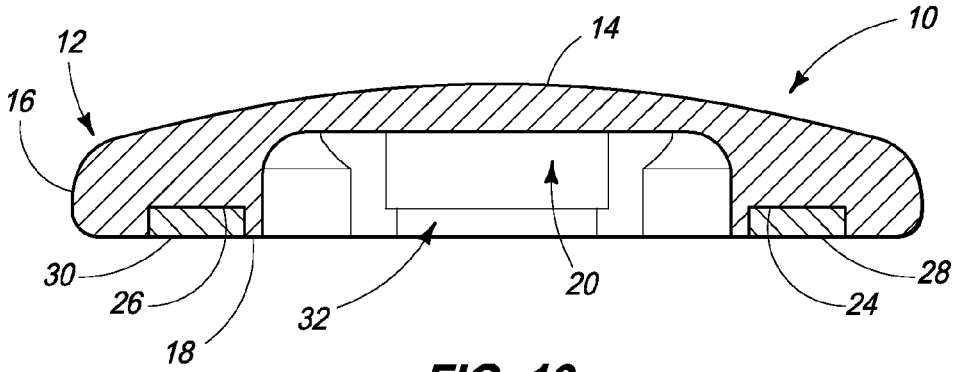
FIG. 13 is a vertical centerline sectional view of the beverage opener taken along line 13-13 of FIG. 3.

FIGS. 9-13 illustrate various structural features of beverage opener 10 in centerline sectional view. FIG. 9 shows recess 20 and recesses 24 and 26 (with magnets removed). FIG. 10 shows through-bore 22 adjacent ledge 38, clearance recess 40, and undercut cavity 40 of bottle opener 32. Opener 32 is opposite opener 34 within recess 20. FIG. 11 further illustrates ledge 38, recess 40 and cavity 42 of opener 32, opposite opener 34 of recess 20. As shown in FIGS. 12 and 13, magnets 28 and 30 are adhesively affixed into recesses 24 and 26, respectively in body 12 of opener 10. Optionally, magnets 28 and 30 can be bonded with an adhesive, such as epoxy, or molded in-place within recesses 24 and 26 (where body is made from a molded material, such as a rigid plastic).

Figure 14:
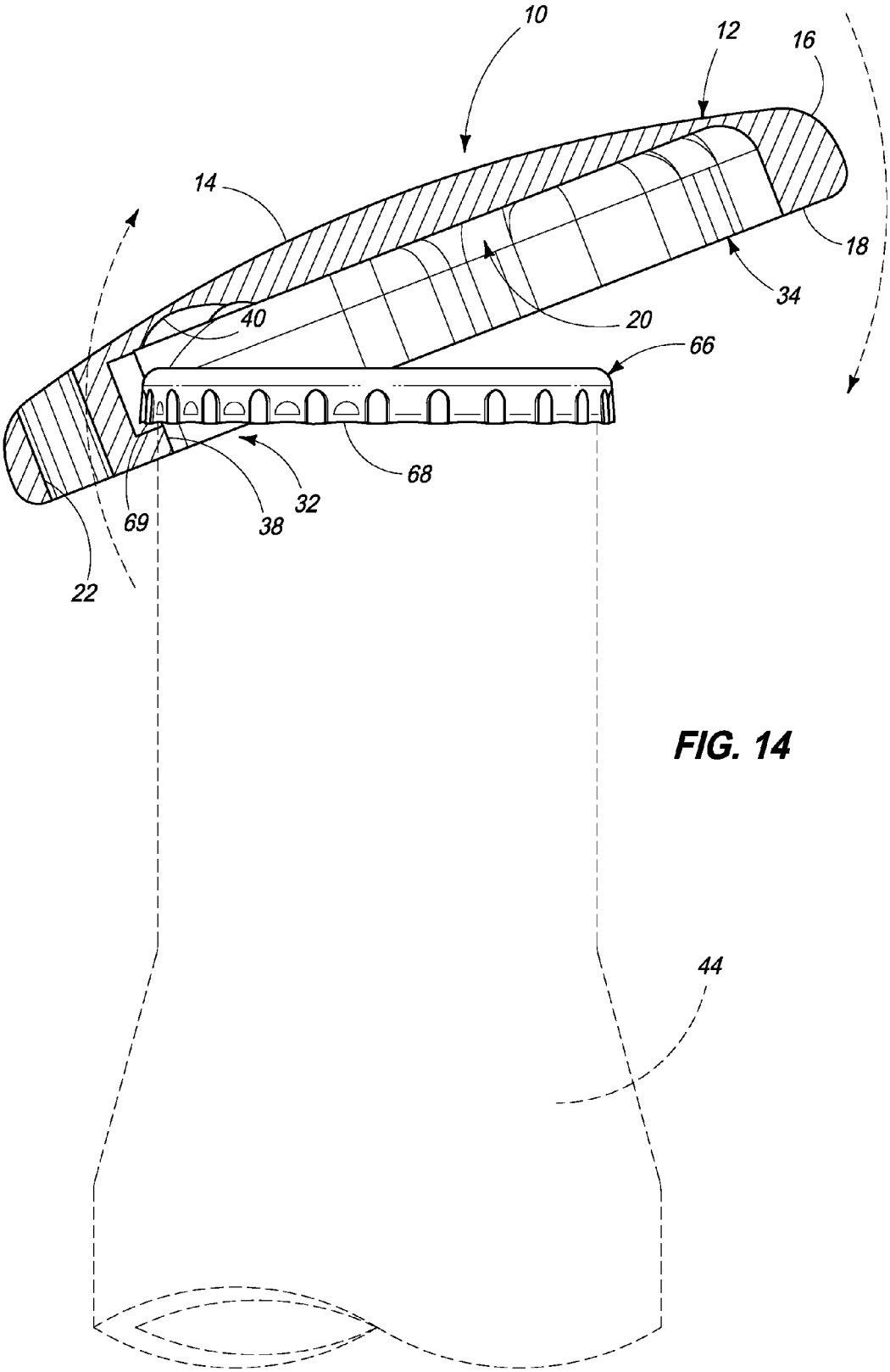
FIG. 14 is a vertical centerline sectional view of the beverage opener of FIGS. 1-13, corresponding with that shown in FIG. 11, and depicting removal of a pry-off crown cap from a bottle.

FIG. 14 illustrates beverage opener 10 in use to remove a crown pry-top bottle cap 66 from a bottle 44 using opener 32. A user's hand (not shown) grips beverage opener 10, seats a distal edge of cap 66 beneath ledge 38 of opener 32. A user then downwardly depresses opener 10 toward a proximal end of cap 66, causing ledge 38 to upward and radially outwardly pry cap edge 69 (and flutes 68) away from a lip edge of bottle 44 until cap 66 is released from bottle 44. During insertion of cap 66 beneath ledge 38, recess 20 facilitates tactile navigation of cap into pry-off crown cap opener 32. Recess 40 provides clearance for a top edge of cap 66 while manipulating cap 66 beneath ledge 38. The rounded, or radiused edges of outer peripheral wall portion 16 combine with the hemispherical top surface 14 to provide a larger hand-conforming surface area that distributes pressure as a user urges opener 16 toward cap 66 when prying off cap 66 from bottle 44.

Figure 15:
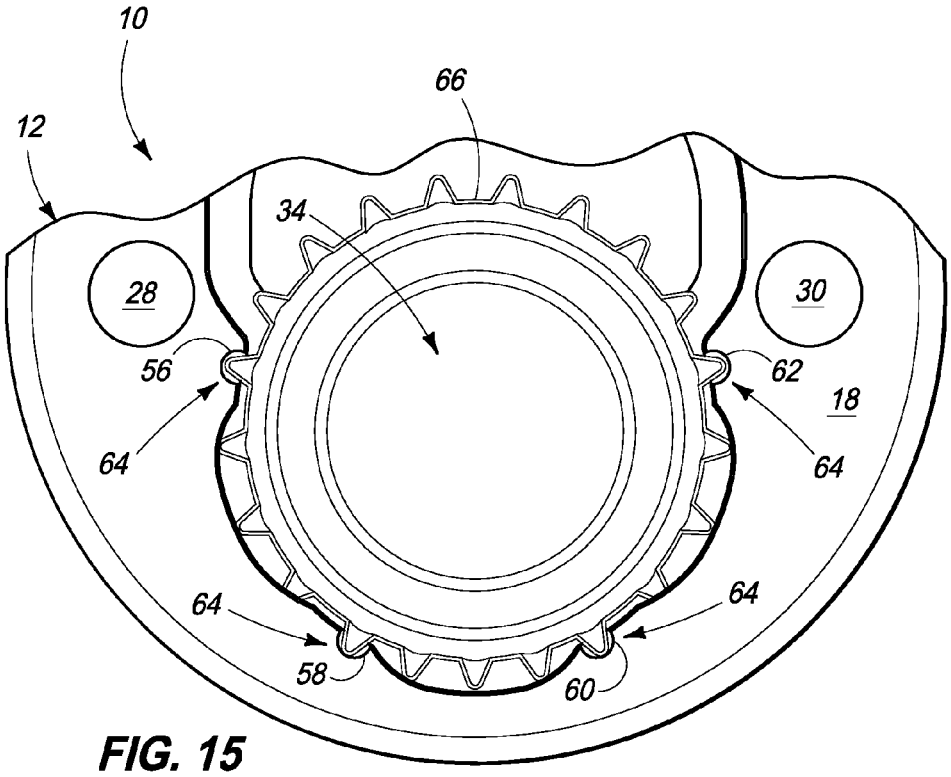
FIG. 15 is a partial plan view from below of the beverage opener of FIGS. 1-14 with a 21-flute crown cap received in the twist-off opener of the beverage opener.
Figure 16:
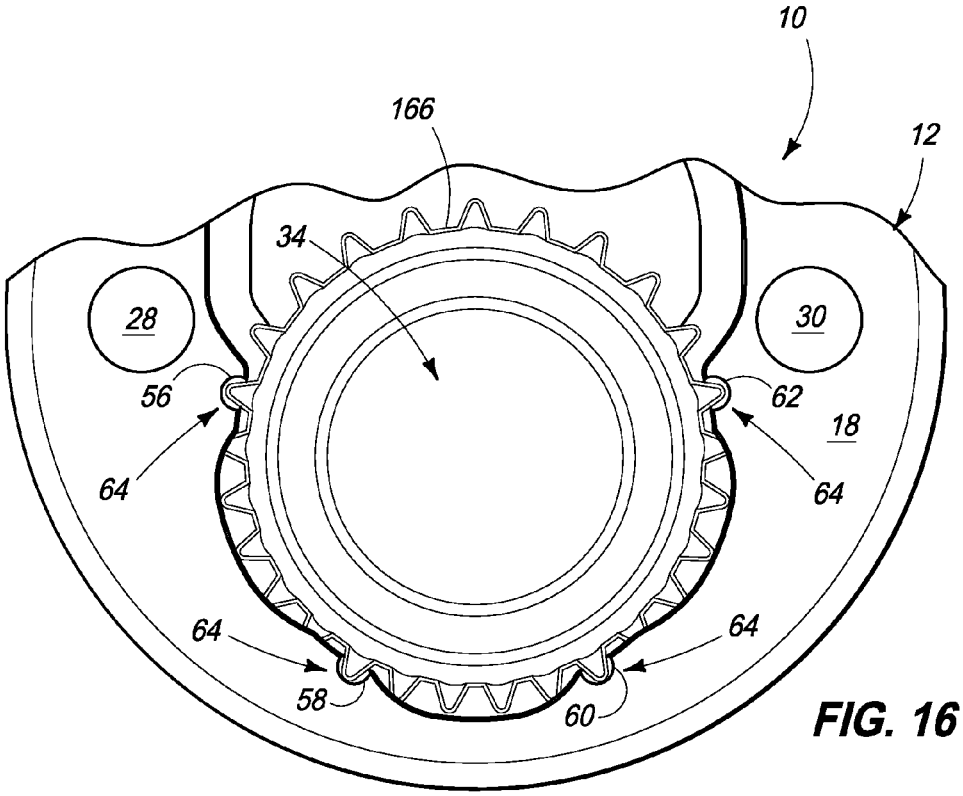
FIG. 16 is a partial plan view from below of the beverage opener of FIG. 16 with a 27-flute crow cap received in the twist-off opener of the beverage opener.

FIG. 15 depicts twist-off opener 32 of beverage opener 10 receiving a first bottle cap 66 having a first array of notches on one twist-off bottle cap 66, and FIG. 16 depicts twist-off opener 32 receiving a second bottle cap 166 having a second, distinct array of notches on another twist-off bottle cap 166. Recesses 56, 58, 60 and 62 are provided in a spaced-apart circumferential array at specific locations that accommodate two unique configurations of ribs 56 on bottle cap 66 and bottle cap 166.

Figure 17:
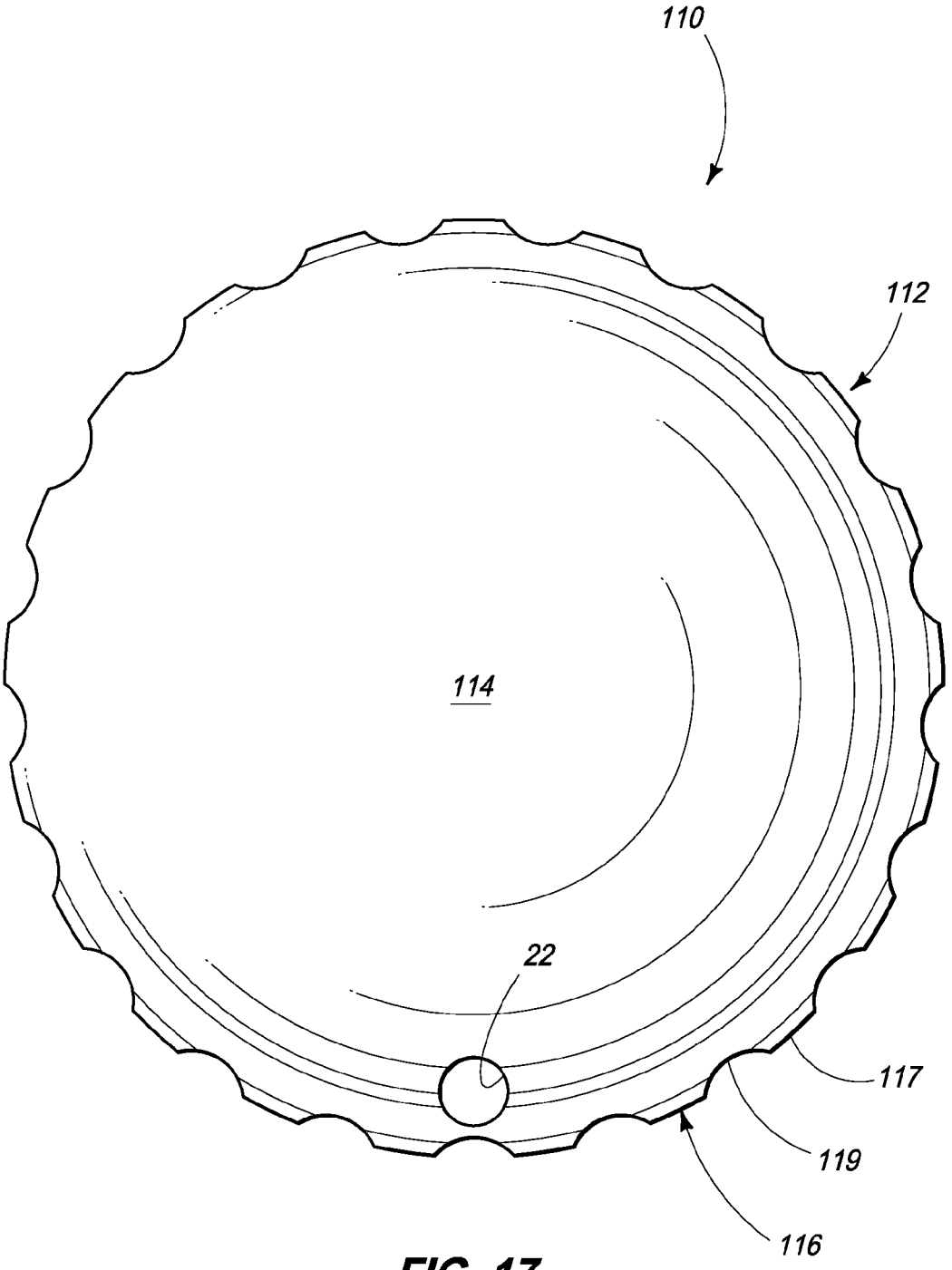
FIG. 17 is a plan view from above of a beverage opener according to another aspect.
Figure 18:
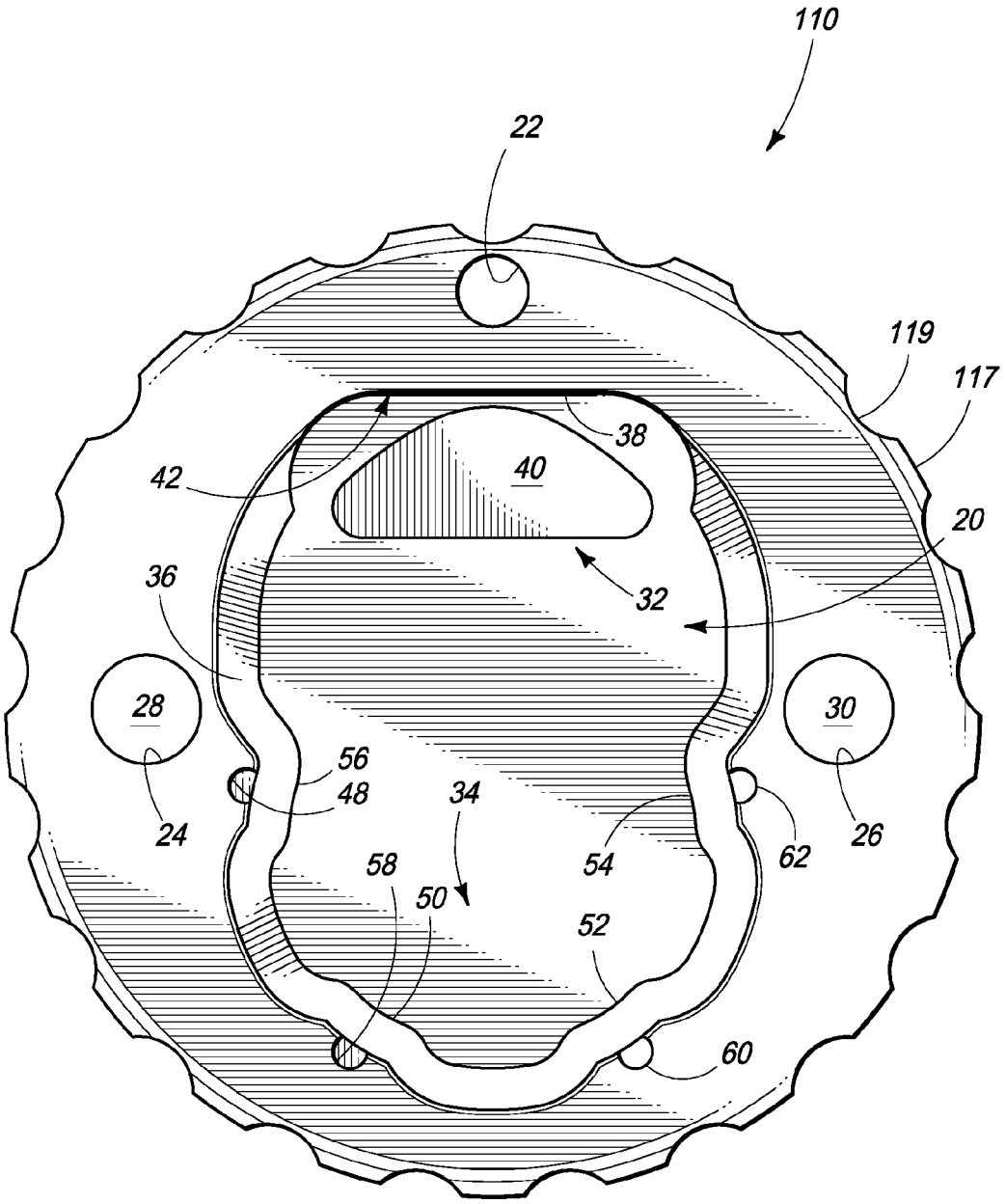
FIG. 18 is a plan view from below of the beverage opener of FIG. 17.

FIGS. 17 and 18 illustrate an optional construction beverage opener 110 similar to beverage opener 10 of FIGS. 1-16, but further including a knurled outer peripheral wall portion 112 that facilitates gripping of opener 10 with a user's palm when engaging and removing a twist-off crown cap with twist-off crown cap opener 34.

Figure 19:
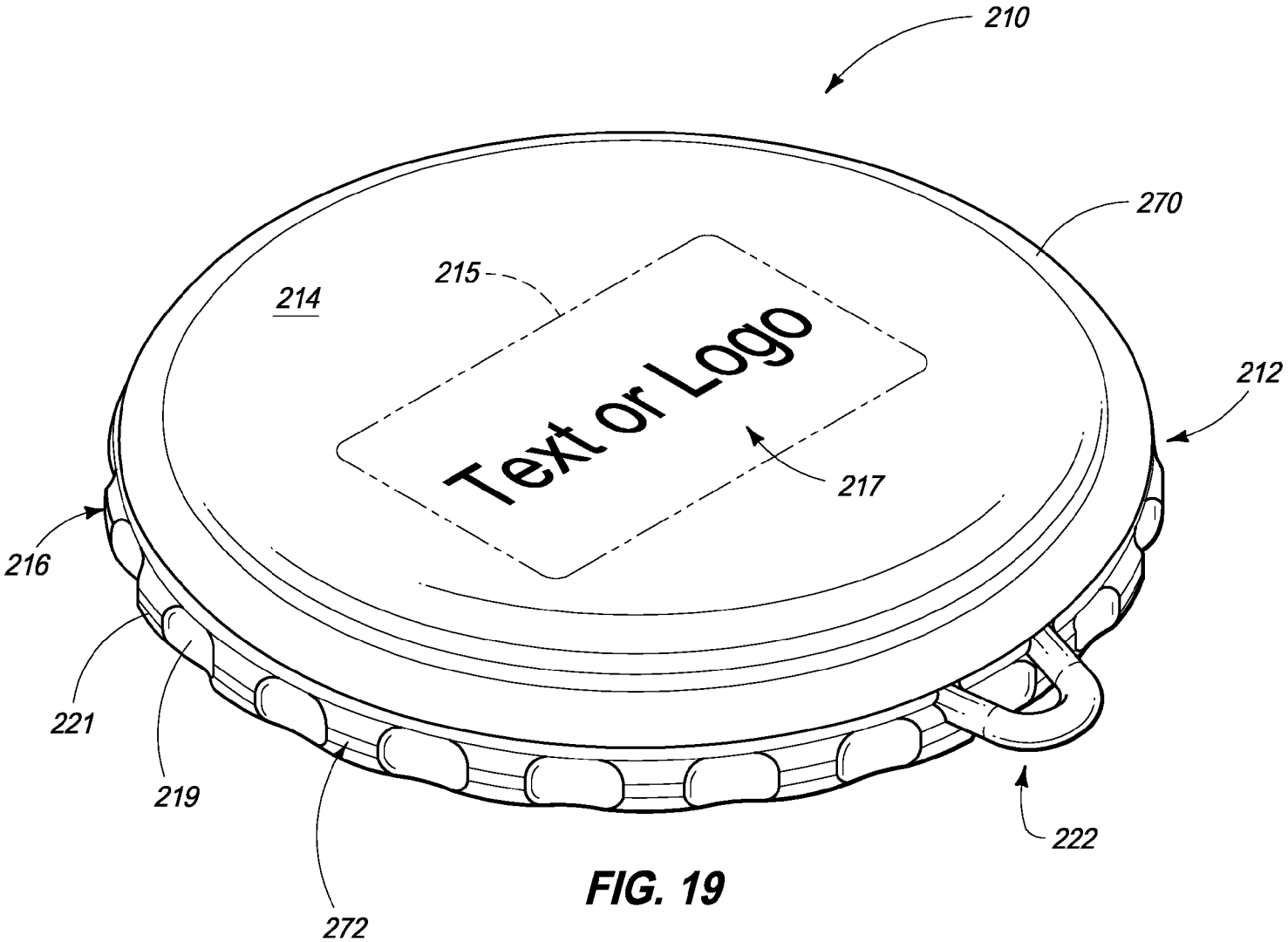
FIG. 19 is perspective view from above of a beverage opener according to yet another aspect.
Figure 20:
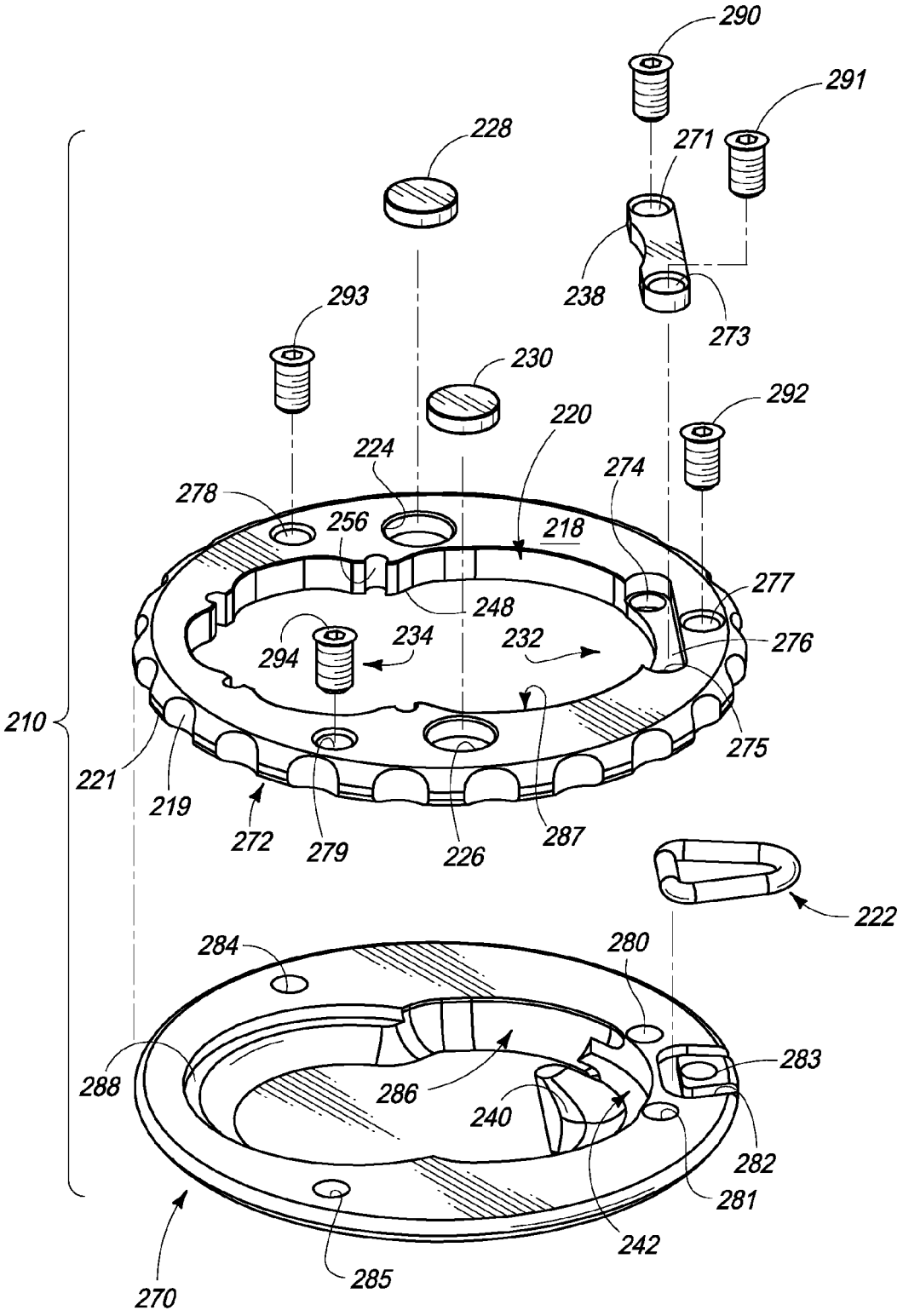
FIG. 20 is an exploded perspective view of the bottom of the beverage opener of FIG. 19.

FIGS. 19 and 20 illustrate yet another optional construction beverage opener 210 wherein a disk-shaped body 212 is formed from a pair of an upper body portion 270 that mates in complementary relation with a lower body portion 272. More particularly, upper body portion 270 can be formed from an exotic, fashionable, or ornamentally desirous material, such as Damascus, Mokume-gane, mild steel (Koftgari) inlayed patterns into the metal, stainless steel with hand etched artwork on the top surface, nickel silver with brazed on silver artwork, carbon fiber, linen micarta, hardened plastic (injected molded), any of a number of hardwoods, or even softer woods, such as teak wood. Likewise, lower body portion 272 can be formed from a suitable piece of structural material, such as aluminum, stainless steel, titanium, brass, or high impact plastic. Further additional materials are suitable.

As shown in FIG. 19, a decorative feature or a promotional branding surface portion 215 is provided atop hemispherical top surface 214 of upper body portion 270. In the case where lower body portion 272 is made from an ornamentally desirous material, an inlayed pattern can provide an image/design component 217 within promotional branding surface portion 215. Optionally, image/design component 217 can be omitted from top surface 214 of beverage opener 210. A circumferential array of equally spaced-apart scallops 219 are provided about outer peripheral wall portion 216, defining individual knurls 221 that provide gripping projections about an outer periphery of disk-shaped body 212 for a user's hand. Furthermore, a lanyard link 222 is provided on body 212 for attachment of a lanyard and/or a keychain.

FIG. 20 illustrates in exploded perspective view the assembly of beverage opener 210. More particularly, lower body 272 is affixed to upper body 270 with a plurality of individual threaded fasteners 292-294 received into counter-sunk through-bores 277-279 in body 272 and into respective complementarily threaded bores 283-285. Similarly, individual threaded fasteners 290 and 291 are received through counter-sunk through-bores 271 and 273 provided in pry lip insert 238 and extend into complementary threaded bores 280 and 281 in body 270. Optionally, where body 270 is made from wood or a relatively softer material, individual knife thread metal inserts can be inserted into each bore 280-285. Pry lip insert 238 is made from a piece of hardened steel or some other suitable structural material, and is received into a complementary recess 276, enabling replacement of insert 238 resulting from extended use and wear. Finally, magnets 228 and 230 are adhesively affixed within complementary bores 224 and 226 in bottom surface 218, such as with cyanoacrylate. Bottle openers 232 and 234 are provided at opposite ends of recess 220, in a manner similar to that depicted in the embodiment of FIGS. 1-16.

As shown in FIG. 20, recess 220 is formed by a recess 286 in upper body 270 and an aperture 287 in lower body 272. A U-shaped groove 282 is provided in upper body 270 sized to receive and retain lanyard link 222 when bodies 270 and 272 are assembled together. In assembly, insert 238 is received in recess 276 to provided undercut cavity 242 there beneath, adjacent clearance recess 240. A circular groove segment 288 is provided in upper body 270 to provide an undercut relative to individual projections and notches (such as projection 248 and notch 256) along twist-off bottle opener 234.

FIGS. 21-24 illustrate yet even another optional construction beverage opener 310 wherein a disk-shaped body 312 is formed from an upper body portion 370 and a lower body portion 372 that mates in complementary relation with an upper body portion 370. More particularly, upper body portion 370 can be formed from an exotic, fashionable, or ornamentally desirous material, such as the materials used and described to form upper body portion 270 in FIGS. 19 and 20. Likewise, lower body portion 372 can be formed from a suitable piece of structural material, such as the materials used and described to form lower body portion 272 in FIGS. 19 and 20. Further additional materials are suitable.

Figure 21:
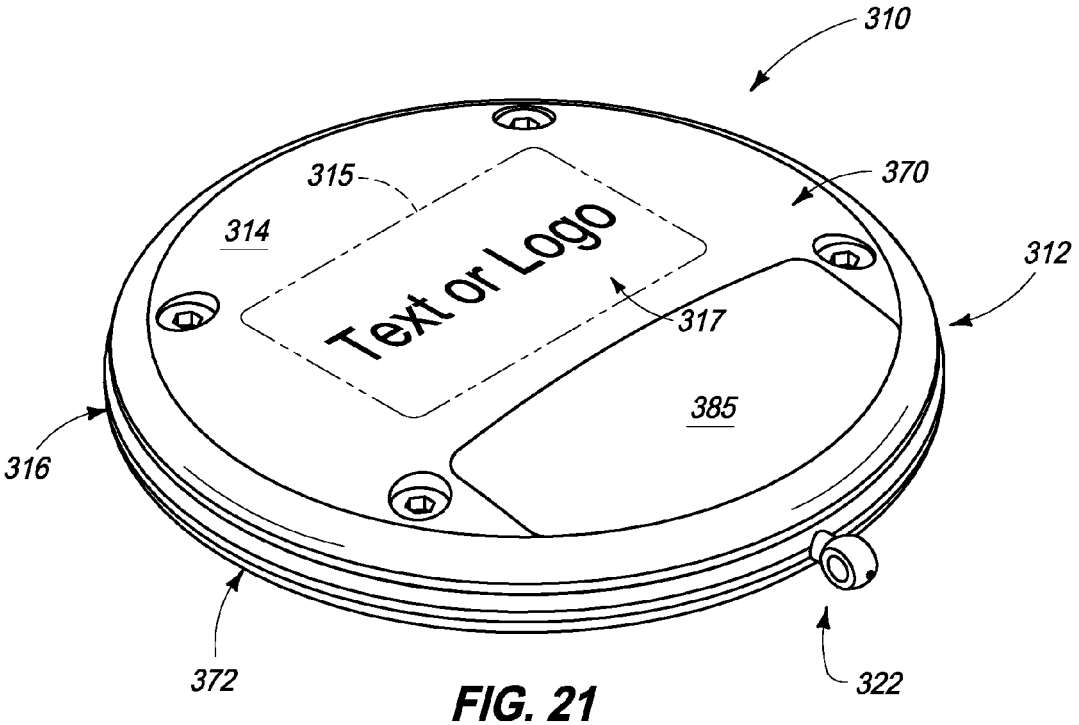
FIG. 21 is a perspective view from above of a beverage opener according to yet even another aspect.

As shown in FIG. 21, a decorative feature or a promotional branding surface portion 315 is provided atop hemispherical top surface 314 of upper body portion 370. A raised portion 385 of lower body portion 372 extends flush with hemispherical top surface 314 to form a portion thereof. Raised portion 385 is integrally formed with lower body portion 385 such that raised portion 385 is structurally stronger than upper body portion 370. Accordingly, strength is added to pry-off crown cap bottle opener 332 (see FIG. 22) by raised portion 385, particularly when upper body portion 370 is constructed from a less strong, and ornamentally desirable material. In the case where lower body portion 372 is made from an ornamentally desirous material, an inlayed pattern can provide an image/design component 317 within promotional branding surface portion 315. Optionally, image/design component 317 can be omitted from top surface 314 of beverage opener 310. Furthermore, a lanyard link 322 is provided on body 312, extending radially outwardly from outer peripheral wall portion 316, for attachment of a lanyard and/or a keychain.

Figure 22:
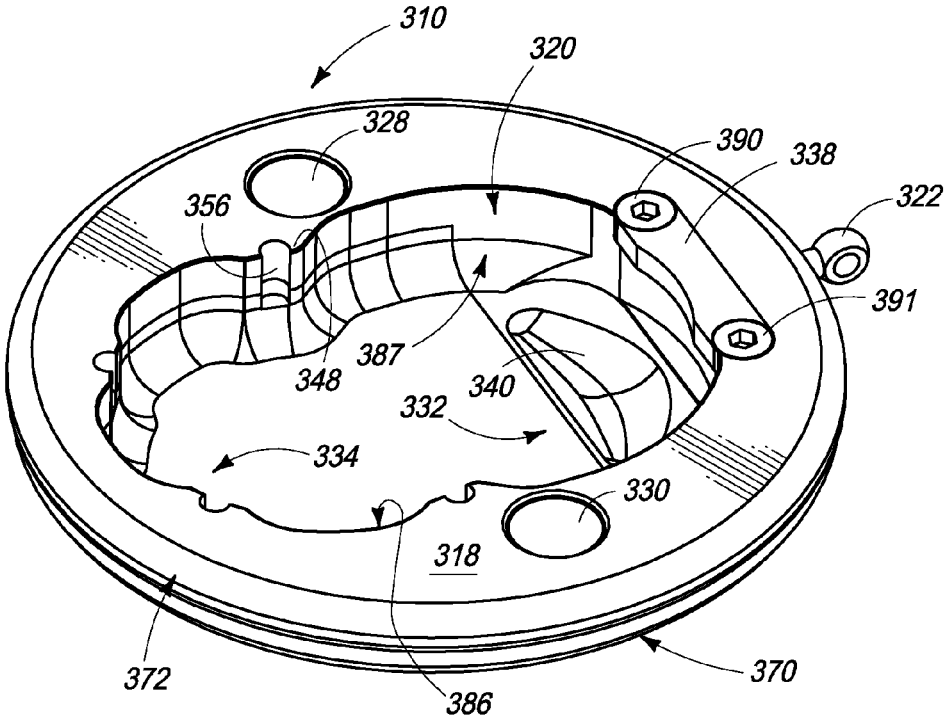
FIG. 22 is a perspective view from below of the beverage opener of FIG. 21.
Figure 23:
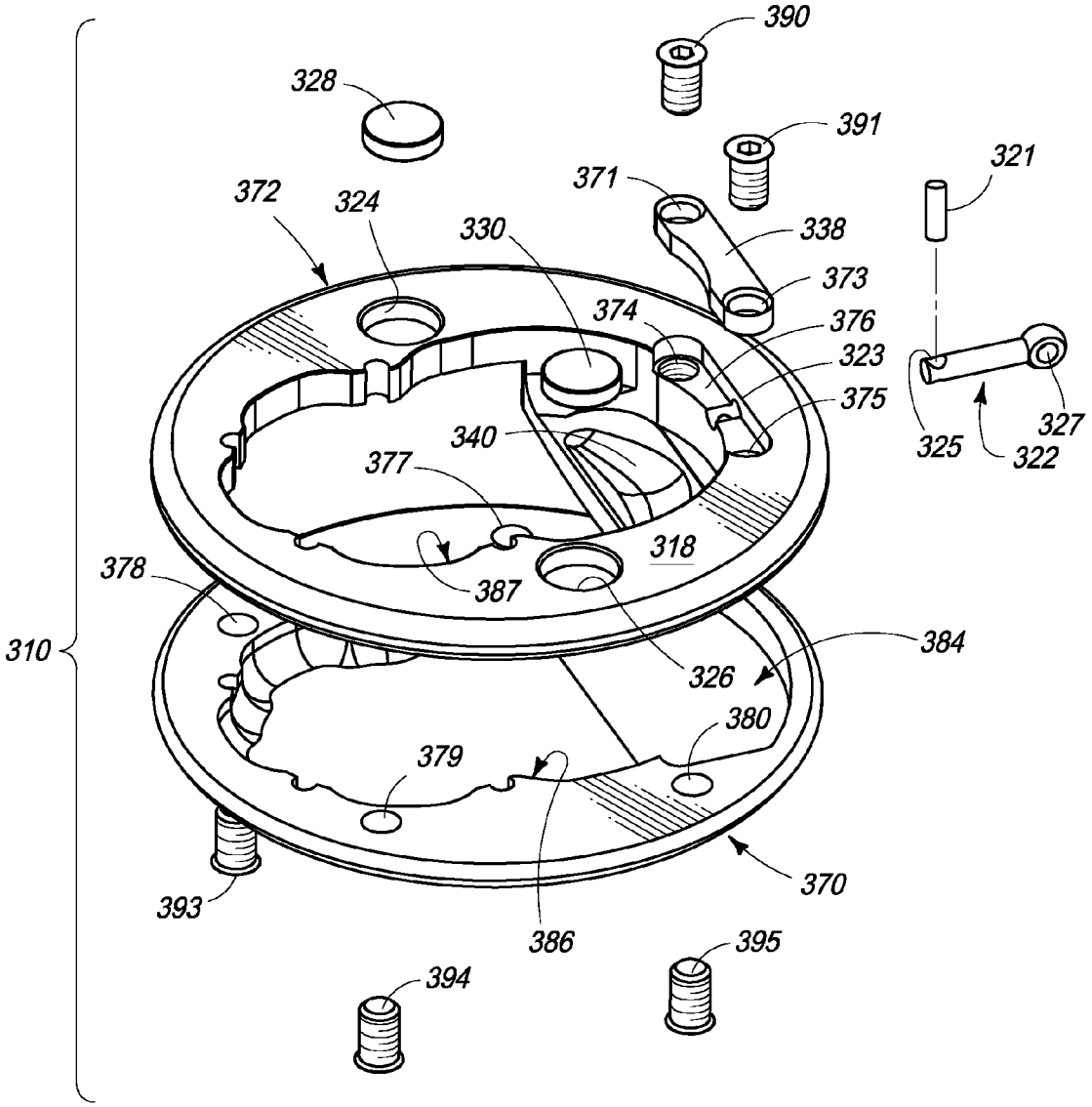
FIG. 23 is an exploded perspective view from below of the beverage opener of FIGS. 21-22.

FIG. 22 is a perspective view of beverage opener 310 while upside down, showing details of pry-off crown cap opener 332 and twist-off crown cap opener 334. A recess 320 is formed by a recess 386 in upper body portion 370 and an aperture 387 in lower body portion 372, as shown in FIGS. 22 and 23. A hardened steel pry lip insert 338 cooperates with arcuate clearance recess 340 to provide pry-off crown cap opener 332. An array of individual projections and notches (such as projection 248 and notch 256) are provided along one end of recess 320 to provided twist-off crown cap bottle opener 334, opposite pry-off crown cap bottle opener 332. Magnets 328 and 330 provided within bottom surface 318 of lower body portion 372 enables a user to store and display beverage opener 310 on a steel surface, such as a door on a refrigerator.

Figure 24:
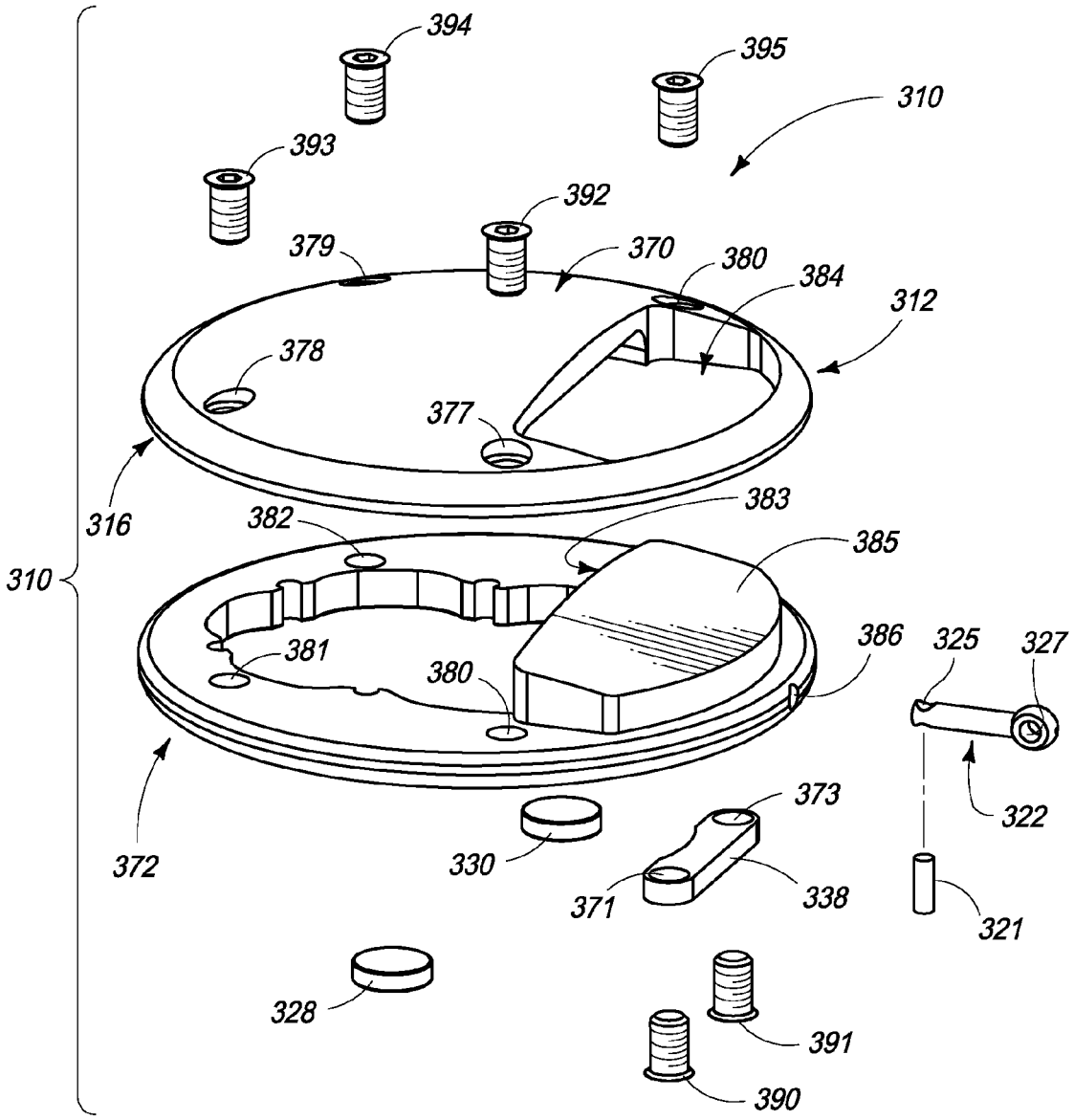
FIG. 24 is an exploded perspective view from above of the beverage opener of FIGS. 21-23.

FIGS. 23 and 24 illustrate in exploded perspective view the assembly of beverage opener 310. As shown in FIG. 24, lower body 372 is affixed to upper body 370 with a plurality of individual threaded fasteners 392-394 received through counter-sunk through-bores 377-379 provided in body 370 and extend into respective complementarily threaded bores 377-380 in body 372 (see FIG. 23). Similarly, individual threaded fasteners 390 and 391 are received through counter-sunk through-bores 371 and 373 in pry lip insert 338 and into complementary threaded bores 374 and 375 in body 372 (see FIG. 23). Optionally, where body 370 is made from wood or a relatively softer material, individual knife thread metal inserts can be inserted into each bore 377-380. Pry lip insert 338 is made from a piece of hardened steel or some other suitable structural material, and is received into a complementary recess 376, enabling replacement of insert 338 resulting from extended use and wear. Finally, magnets 328 and 330 are adhesively affixed within complementary bores 324 and 326 in bottom surface 318, such as with cyanoacrylate. Bottle openers 332 and 334 (see FIG. 23) are provided at opposite ends of recess 320, in a manner similar to that depicted in the embodiment of FIGS. 1-16.

As shown in FIG. 23, a lanyard post 322 is received through a bore 386 (see FIG. 24) in body 372 and a retention pin 321 passes through-bore 325 in post 322 and into bore 323, trapping post 322 within body 372 via insert 338. A bore 327 in post 322 is sized to receive a lanyard, tether, or keychain component.

An aperture 384 is provided in upper body 370 sized to receive in conforming relation raised portion 385 of body 372 when bodies 370 and 372 are assembled together. In assembly, raised portion 385 is received in recess 384 to provided a structural support for pry-off crown cap bottle opener 332 (see FIG. 22). Optionally, a top surface of raised portion 385 can include image and/or design components that form part or all of promotional branding surface portion 315 (see FIG. 21).

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A beverage opener, comprising:

a body having a generally planar bottom surface, an outer peripheral edge, and a top surface; and a receiver having a wall portion defining a recess in the bottom surface of the body and having an array of spaced-apart ones of: a) recesses and b) notches disposed about the recess to provide a bottle opener, the array of ones of: a) recesses and b) notches compatibly formed to receive and mate with a first array of another of: a) recesses and b) notches on one twist-off bottle cap and a second, distinct array of another of: a) recesses and b) notches on another twist-off bottle cap.

2. The beverage opener of claim 1, wherein the top surface is generally hemispherical.

3. The beverage opener of claim 1, wherein the wall portion extends generally circumferentially about the recess.

4. The beverage opener of claim 1, wherein the top surface is a portion of a semisphere.

5. The beverage opener of claim 1, wherein the bottle opener is a first bottle opener provided along one peripheral portion of the recess, and further comprising a second bottle opener provided along another peripheral portion of the recess spaced from the first bottle opener.

6. The beverage opener of claim 5, wherein the recess provides an elongate cavity extending between the first peripheral portion and the second peripheral portion, the elongate cavity configured at least in part to provide a guideway (raceway) operative to enable tactile navigation of a bottle cap that is urged into the cavity between the first bottle opener and the second bottle opener.

7. The beverage opener of claim 1, wherein the receiver has an array of spaced-apart recesses each configured to mate with a complementary notch (nib) on the one twist-off bottle cap or the another twist-off bottle cap.

8. The beverage opener of claim 7, wherein the top surface and the outer peripheral edge cooperate to provide at least a portion of a semispherical head having an ergonomically compatible fit-up with a user's hand when rotating the body while a bottle cap is received within the bottle opener.

9. A beverage opener, comprising:

a body having a base with a generally planar bottom surface, an outer peripheral edge, and a top surface; and a receiver having a wall portion defining a recess in the bottom surface of the body and having:

a) a first bottle opener communicating with the recess along one peripheral edge portion including an array of spaced-apart ones of: a) recesses and b) notches disposed about the recess to provide a bottle opener, the array of ones of: a) recesses and b) notches compatibly formed to receive and mate with a first array of another of: a) recesses and b) notches on one twist-off bottle cap and a second, distinct array of another of: a) recesses and b) notches on another twist-off bottle cap; and b) a second bottle opener communicating with the recess along another peripheral edge portion spaced from the first bottle opener.

10. The beverage opener of claim 9, wherein the first bottle opener comprises a twist-off crown cap bottle opener and the second bottle opener comprises a pry-off crown cap bottle opener.

11. The beverage opener of claim 10, wherein the first bottle opener comprises an array of spaced-apart recesses disposed about the receiver to provide a bottle opener, the array of recesses compatibly formed to receive and mate with a first array of notches on one twist-off bottle cap and a second, distinct array of notches on another twist-off bottle cap.

12. The beverage opener of claim 9, wherein the recess provides an elongate cavity extending between the first peripheral portion and the second peripheral portion, the elongate cavity configured at least in part to provide a guideway (raceway) operative to enable tactile navigation of a bottle cap that is urged into the cavity between the first bottle opener and the second bottle opener.

13. The beverage opener of claim 9, wherein the top surface and the outer peripheral edge cooperate to provide at least a portion of a semispherical head having an ergonomically compatible fit-up with a user's hand when rotating the body while a bottle cap is received within the bottle opener.

14. The beverage opener of claim 9, further comprising a promotional branding surface portion provide on the body.

15. A promotional branding beverage opener, comprising:

a body having a bottom surface and a dome-shaped top surface with a promotional branding surface portion configured to receive at least one of: (a) an image and (b) a design component; and an annular peripheral sidewall portion defining a cavity in the bottom surface of the body and having a first bottle opener comprising an array of spaced-apart ones of: a) recesses and b) notches disposed about the cavity to provide a bottle opener, the array of ones of: a) recesses and b) notches compatibly formed to receive and mate with a first array of another of: a) recesses and b) notches on one twist-off bottle cap and a second, distinct array of another of: a) recesses and b) notches on another twist-off bottle cap.

16. The promotional branding beverage opener of claim 15, further comprising a second bottle opener communicating with the cavity and spaced from the first bottle opener.

17. The promotional branding beverage opener of claim 16, wherein the second bottle opener is a pry-off crown cap bottle opener.

18. The promotional branding beverage opener of claim 15, wherein the dome-shaped top surface of the body comprises at least a portion of a semispherical head having an ergonomically compatible fit-up with a user's hand when rotating the body while a bottle cap is received within the bottle opener.

19. The promotional branding beverage opener of claim 15, wherein the first bottle opener comprises an array of spaced-apart recesses disposed about the receiver to provide a bottle opener, the array of recesses compatibly formed to receive and mate with a first array of notches on one twist-off bottle cap and a second, distinct array of notches on another twist-off bottle cap.

20. The promotional branding beverage opener of claim 15, wherein the at least one of: (a) an image and (b) a design component comprises advertising indicia affixed atop the dome-shaped top surface.

* * * * *